US006843239B2

(12) United States Patent
Fensom et al.

(10) Patent No.: US 6,843,239 B2
(45) Date of Patent: Jan. 18, 2005

(54) HIGH SPEED EXHAUST GAS RECIRCULATION VALVE

(75) Inventors: Rod Fensom, Peterborough (GB); David J. Kidder, Peterborough (GB)

(73) Assignee: Caterpillar Inc., Peoria, IL (US)

( * ) Notice: Subject to any disclaimer, the term of this patent is extended or adjusted under 35 U.S.C. 154(b) by 191 days.

(21) Appl. No.: 10/036,832

(22) Filed: Dec. 21, 2001

(65) Prior Publication Data

US 2003/0116146 A1 Jun. 26, 2003

(51) Int. Cl.[7] ..... F02B 47/08
(52) U.S. Cl. ..... 123/568.21; 123/568.23
(58) Field of Search ..... 123/568.21, 568.23, 123/568.24, 568.26, 90.23; 251/129.15, 58

(56) References Cited

U.S. PATENT DOCUMENTS

| | | | | |
|---|---|---|---|---|
| 2,741,233 A | | 4/1956 | McKinley | |
| 3,591,127 A | * | 7/1971 | Luger et al. | 251/36 |
| 3,915,134 A | | 10/1975 | Young et al. | |
| 3,934,564 A | * | 1/1976 | Barnert | 123/568.2 |
| 3,948,231 A | | 4/1976 | Smith | |
| 4,064,851 A | | 12/1977 | Wessel | |
| 4,280,471 A | | 7/1981 | Masaki | |
| 4,473,056 A | | 9/1984 | Ishida et al. | |
| 4,535,813 A | * | 8/1985 | Spain | 137/625.5 |
| 4,549,446 A | | 10/1985 | Beeson | |
| 4,561,408 A | | 12/1985 | Jenkins | |
| 4,794,847 A | * | 1/1989 | Kreuter et al. | 92/136 |
| 4,911,399 A | * | 3/1990 | Green | 251/6 |
| 4,924,840 A | | 5/1990 | Wade | |
| 5,346,173 A | * | 9/1994 | Rasmusson | 251/58 |
| 5,531,205 A | | 7/1996 | Cook et al. | |
| 5,579,743 A | | 12/1996 | Kadowaki | |
| 5,749,350 A | | 5/1998 | Bender | |
| 6,408,886 B1 | * | 6/2002 | Milano et al. | 137/899 |

FOREIGN PATENT DOCUMENTS

| | | | |
|---|---|---|---|
| EP | 0 887 541 A2 | | 12/1998 |
| JP | 2000130201 A | * | 5/2000 |

* cited by examiner

*Primary Examiner*—Mahmoud Gimie
(74) *Attorney, Agent, or Firm*—Marshall, Gerstein & Borun

(57) ABSTRACT

In order to minimize pollutants such as Nox, internal combustion engines typically include an exhaust gas recirculation (EGR) valve that can be used to redirect a portion of exhaust gases to an intake conduit, such as an intake manifold, so that the redirected exhaust gases will be recycled. It is desirable to have an EGR valve with fast-acting capabilities, and it is also desirable to have the EGR valve take up as little space as possible. An exhaust gas recirculation valve is provided that includes an exhaust passage tube, a valve element pivotally mounted within the exhaust passage tube, a linear actuator; and a gear train. The gear train includes a rack gear operatively connected to the linear actuator, and at least one rotatable gear meshing with the rack gear and operatively connected to the valve element to cause rotation of the valve element upon actuation of the linear actuator. The apparatus provides a highly compact package having a high-speed valve actuation capability.

11 Claims, 5 Drawing Sheets

HIGH SPEED EXHAUST GAS RECIRCULATION VALVE

This invention was made with United States Government support under Contract No. DE-FC05-97OR22605, RS96-006, entitled "Light Truck Clean Diesel (LTCD Program)", awarded by the United States Department of Energy. The United States Government has certain rights in this invention.

TECHNICAL FIELD

The present invention relates generally to exhaust gas recirculation valves and, more particularly, to devices and methods for opening and closing exhaust gas recirculation valves.

BACKGROUND

In order to minimize pollutants such as Nox, internal combustion engines typically include an exhaust gas recirculation (EGR) valve. The exhaust gas recirculation valve can be used to redirect a portion of exhaust gases to an intake conduit, such as an intake manifold, so that the redirected exhaust gases will be recycled.

Smith, U.S. Pat. No. 3,948,231 discloses a power and deceleration governor for automotive engines, that includes a butterfly type mixture control valve. In a first embodiment of the governor, the mixture control valve is actuated using a rack and pinion arrangement, driven by a diaphragm motor. In a second embodiment of the governor, the mixture control valve is actuated using a hydraulic cylinder. In a third embodiment of the governor, the mixture control valve is actuated using a clutch drive motor.

However, in all three embodiments disclosed in U.S. Pat. No. 3,948,231, the governor has a somewhat bulky structure, with an actuating shaft oriented generally transverse to a flow passage that contains the butterfly type mixture control valve, which could lead to packaging difficulties for engine applications in which space for such mechanisms is limited. In addition, all three embodiments rely on a vacuum system, that may not provide fast valve response. Thus, it is desirable to have an EGR valve that is both fast-acting, and compact in design.

The present invention is directed to overcoming one or more of the problems or disadvantages associated with the prior art.

SUMMARY OF THE INVENTION

An exhaust gas recirculation valve is provided that includes an exhaust passage tube, a valve element pivotally mounted within the exhaust passage tube, a linear actuator, and a gear train. The gear train includes a rack gear operatively connected to the linear actuator, and at least one rotatable gear meshing with the rack gear and operatively connected to the valve element to cause rotation of the valve element upon actuation of the linear actuator.

A method of actuating an exhaust gas recirculation valve is also provided. The method includes the steps of energizing a linear actuator, moving a rack gear operatively connected to the linear actuator, and rotating at least one rotatable gear operatively connected with a valve element to thereby rotate the valve element.

BEST MODE FOR CARRYING OUT THE INVENTION

Figure 1:
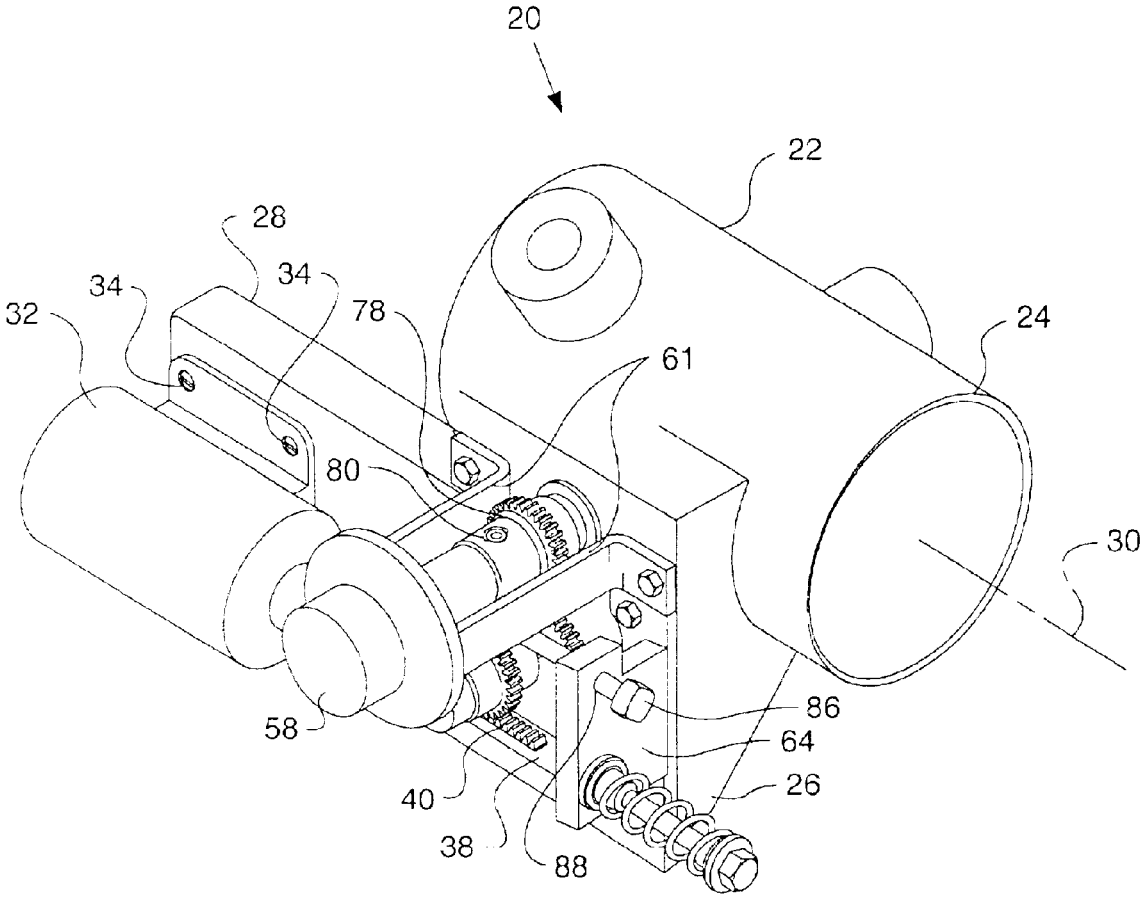
FIG. 1 is an isometric view of an exhaust gas recirculation valve assembly in accordance with the invention.
Figure 2:
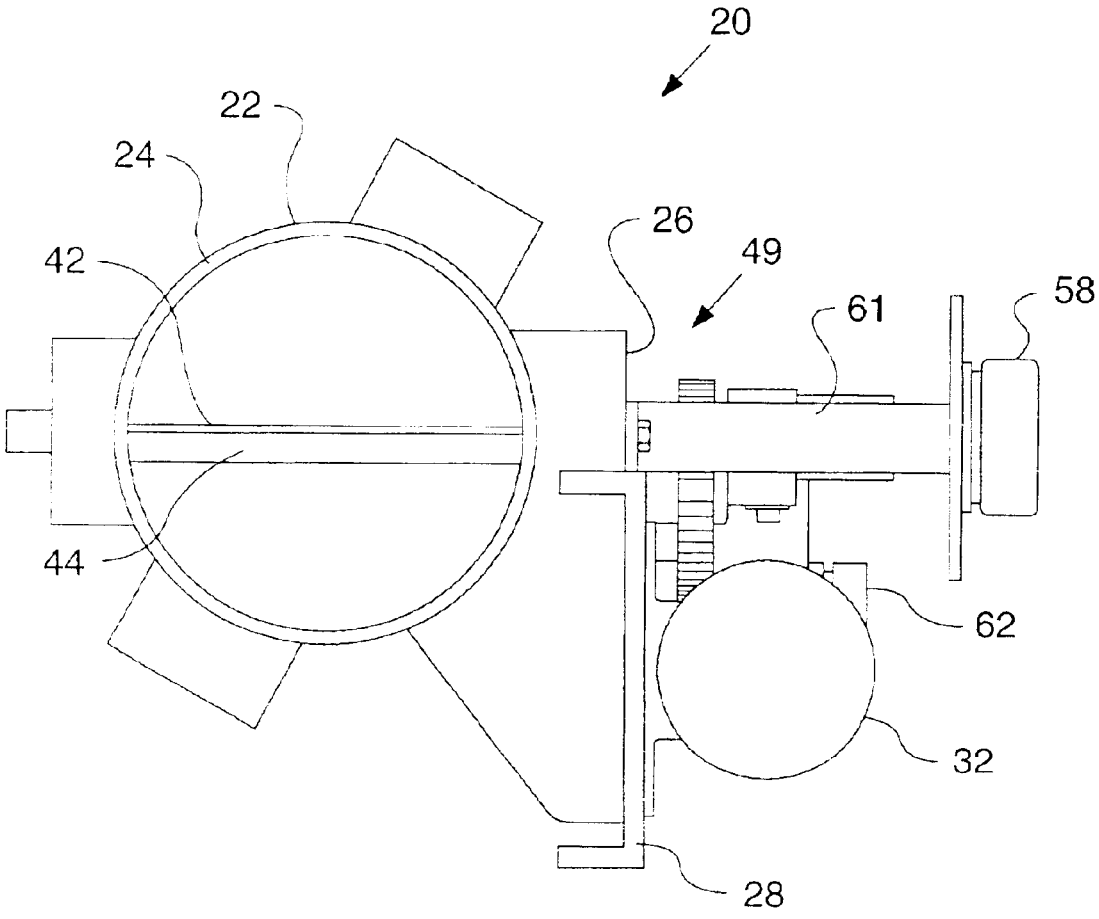
FIG. 2 is a front elevational view of the exhaust gas recirculation valve assembly of FIG. 1.

With reference to FIGS. 1 and 2, an exhaust gas recirculation valve assembly in accordance with the invention, generally indicated at 20, includes a valve housing 22. The valve housing 22 includes a generally cylindrical exhaust passage tube 24 and a generally planar mounting surface 26. An actuator mounting plate 28 extends beyond the mounting surface 26 generally parallel to a central axis 30 of the exhaust passage tube 24.

Figure 3:
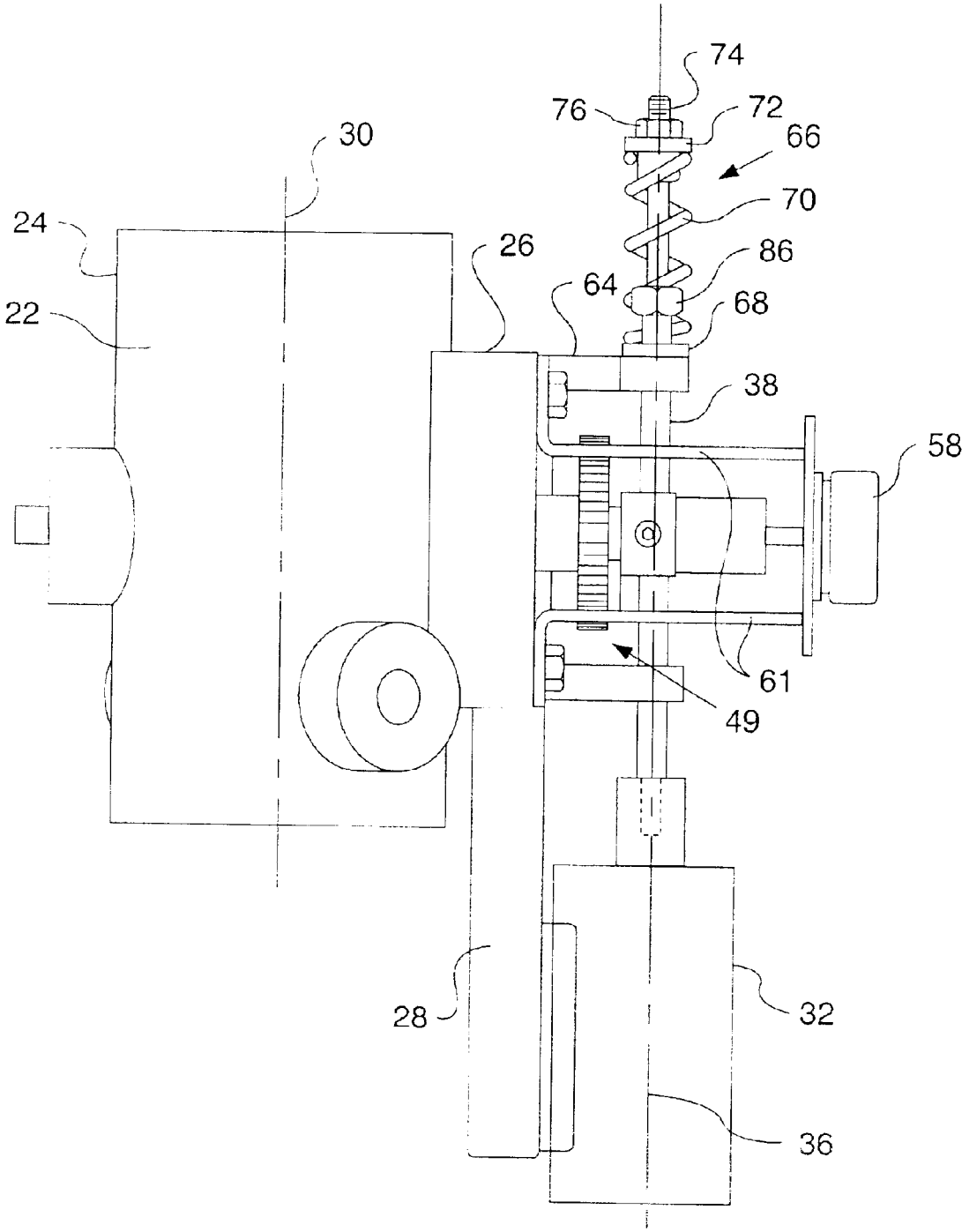
FIG. 3 is a plan view of the exhaust gas recirculation valve assembly of FIG. 1.
Figure 4:
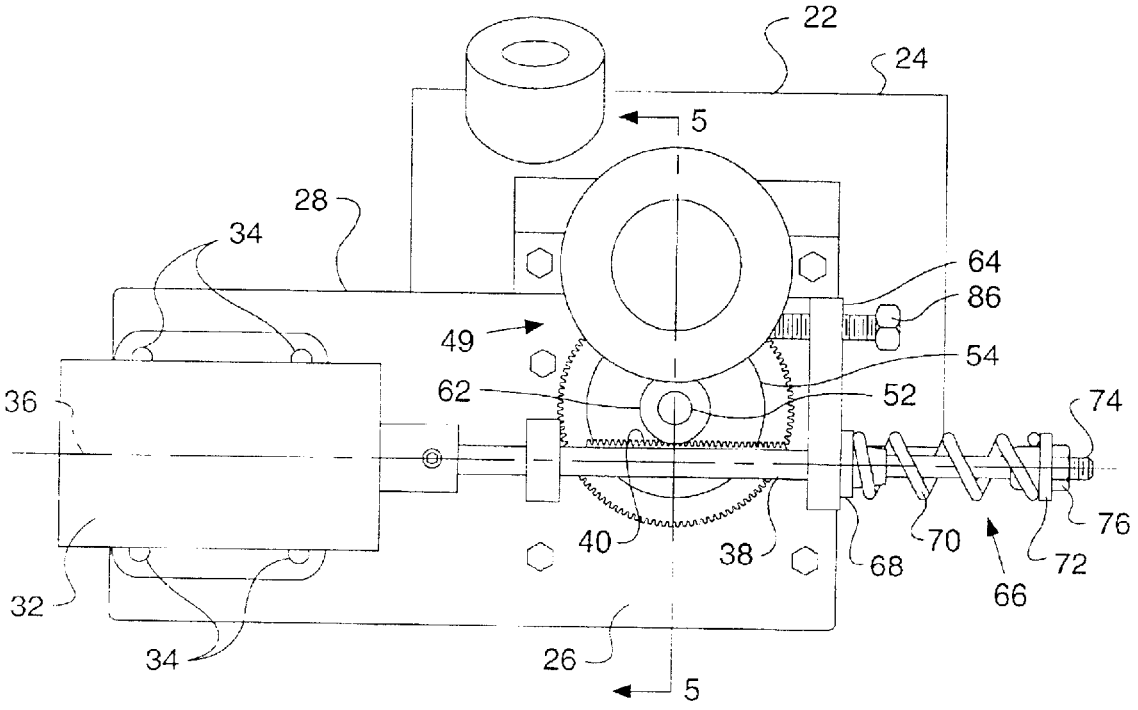
FIG. 4 is a side elevational view of the exhaust gas recirculation valve assembly of FIG. 1.

A linear actuator 32 is attached to the actuator mounting plate 28 by mounting screws 34. As best seen in FIGS. 3 and 4, the linear actuator 32 has a central axis 36 that is substantially parallel to the axis 30 of the exhaust passage tube 24. The linear actuator 32 directly drives a flap actuator rod 38, having a rack gear 40 disposed along part of its length. The linear actuator 32 may be, for example, a solenoid, a piezo stack, a piezo bender, linear motor, a hydraulic actuator, or a pneumatic actuator.

Figure 5:
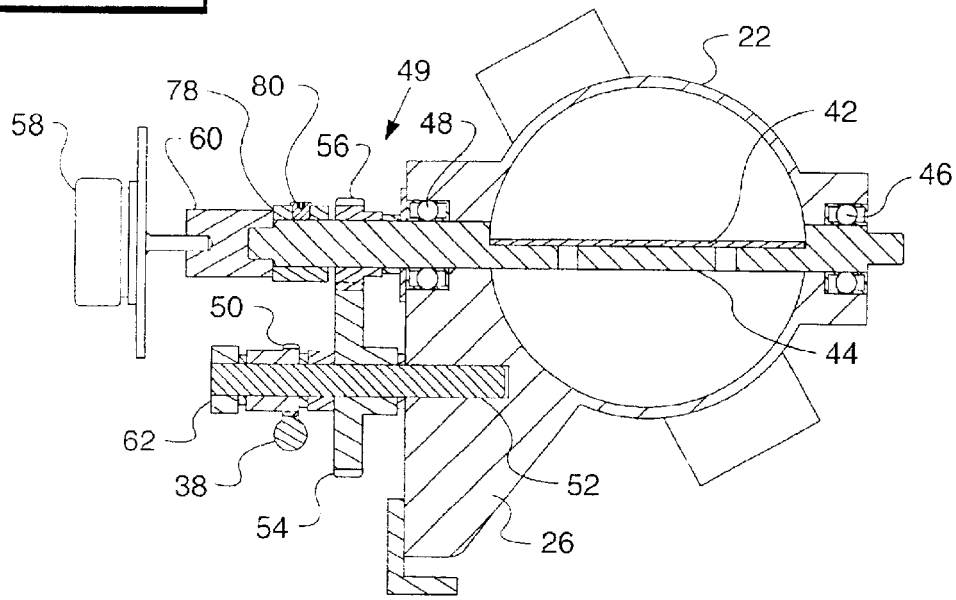
FIG. 5 is a partial cross-sectional view of the exhaust gas recirculation valve assembly of FIG. 1, taken along lines 5—5 of FIG. 4.

A butterfly type flap valve element 42 is pivotally mounted within the exhaust passage tube 24 by means of a flap valve spindle 44 to which the flap valve element 42 is mounted. The flap valve spindle 44 is pivotally mounted to the valve housing 22 via bearings 46 and 48 (FIG. 5). The rack gear 40 is a component of a gear train, generally indicated at 49, that is operatively connected to convert the linear motion of the flap actuator rod 38 into rotational motion of the flap valve spindle 44. The flap actuator rod 38 engages a first idler gear 50 mounted to an idler shaft 52 for rotation therewith, which in turn is rotatably mounted to the housing 22 on the mounting surface 26.

A second idler gear 54 having a diameter significantly larger than the diameter of the first idler gear 50, is also mounted to the idler shaft 52 for rotation therewith. The second idler gear 54 in turn engages a spindle gear 56 mounted to the flap valve spindle 44. The flap valve spindle 44 is connected to a potentiometer 58 via a first Oldham coupling 60. The potentiometer 58 is fixed to the mounting flange 26 by a bracket assembly 61. The idler shaft 52 is secured on its end opposite the valve housing 22 by a second Oldham coupling 62.

The flap actuator rod 38 passes through a spring support flange 64 that extends in a direction that is generally normal to the mounting surface 26. An actuator return spring assembly 66 is mounted to the spring support flange 64, as best seen in FIGS. 3 and 4. The actuator return spring assembly 66 includes: a spring support collar 68 attached to the spring support flange 64; a coil spring 70, that surrounds the flap actuator rod 38; and a threaded spring support collar 72 that is secured to a threaded end portion 74 of the flap actuator rod 38 by a collar locking nut 76.

Figure 6:
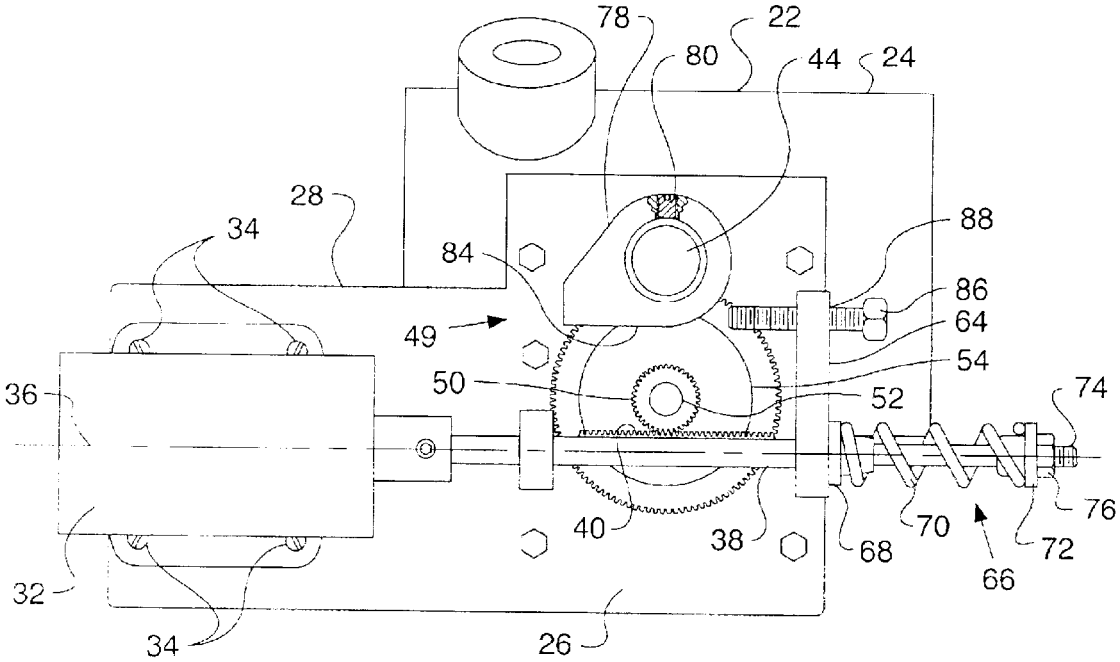
FIG. 6 is an enlarged fragmentary view similar to FIG. 4, of the exhaust gas recirculation valve assembly of FIG. 1, showing structure thereof that is hidden by a potentiometer in FIG. 4.

As shown in FIG. 6, a stop lever 78 is mounted to the flap valve spindle 44 for rotation therewith by means of a grub screw 80. The stop lever 78 includes a stop surface 84. A threaded stop screw 86 passes through, and is threadably received by an aperture 88 in the spring support flange 64. Upon sufficient rotation of the flap valve spindle 44 in a counterclockwise direction as oriented in FIG. 6, the stop surface 84 will contact the stop screw 86, thereby limiting the rotational travel of the flap valve spindle 44.

INDUSTRIAL APPLICABILITY

When the linear actuator 32 is energized, for example, by providing electrical current to the linear actuator 32 in the case of a solenoid-type actuator, the flap actuator rod 38 is quickly pulled in a direction toward the linear actuator 32 (i.e., the flap actuator rod 38 moves toward the left as oriented in FIGS. 4 and 6). As the flap actuator rod 38 moves toward the linear actuator 32, the rack gear 40 disposed on the flap actuator rod 38 drives the first idler gear 50 in a clockwise direction as oriented in FIG. 4, which in turn causes the idler shaft 52 and the second idler gear 54 to also rotate in a clockwise direction as oriented in FIGS. 4 and 6.

The clockwise rotation of the second idler gear 54 imparts a counterclockwise rotation to the spindle gear 56 which in turn drives the flap valve spindle 44 also in a counterclockwise direction as oriented in FIGS. 4 and 6. The rotation of the flap valve spindle 44 results in the flap valve element 42 quickly rotating to a closed position.

The movement of the flap actuator rod 38 results in compression of the coil spring 70 between the threaded spring support collar 72 and the spring support collar 68. Accordingly, when the linear actuator 32 is deenergized, the coil spring 70 urges the flap actuator rod 38 in a direction away from the linear actuator 32, thereby driving the first idler gear 50 in a counterclockwise direction resulting in counterclockwise rotation of the idler shaft 52 and counterclockwise rotation of the second idler gear 54, as oriented in FIGS. 4 and 6.

The counterclockwise rotation of the second idler gear 54 in turn drives the spindle gear 56 to rotate in a clockwise direction thereby rotating the flap valve spindle 44 and the flap valve element 42 in a clockwise direction as oriented in FIGS. 4 and 6, such that the flap valve element 42 moves toward an open position.

The use of the invention results in a compact, fast-acting configuration that is capable of providing 80° of rotational displacement of the flap valve element 42 in approximately 30 milliseconds, with an actuator stroke of approximately 6 millimeters.

By varying the travel of the linear actuator 32, for example, by adjusting the stop screw 86 and/or by altering the gear geometry and/or the geometry of the stop lever 78, the rotation angle of the flap valve element 42 can be varied. In addition, if desired, the exhaust gas recirculation valve assembly 20 could of course be configured such that the flap valve element 42 would be in a closed position when the linear actuator 32 is deenergized.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

Other aspects and features of the present invention can be obtained from a study of the drawings, the disclosure, and the appended claims.

What is claimed is:

1. An exhaust gas recirculation valve comprising:

an exhaust passage tube, wherein the exhaust passage tube is aligned along an axis and the linear direction is parallel to the axis;

a valve element pivotally mounted entirely within the exhaust passage tube;

a linear actuator; and a gear train including a rack gear operatively connected to the linear actuator, the rack gear adapted to move in a substantially linear direction upon activation of the linear actuator, and at least one rotatable gear meshing with the rack gear and operatively connected to the valve element to cause rotation of the valve element upon actuation of the linear actuator.

2. An exhaust gas recirculation valve comprising:

an exhaust passage tube;

a valve element pivotally mounted entirely within the exhaust passage tube;

a linear actuator; and a gear train including a rack gear operatively connected to the linear actuator, the rack gear adapted to move in a substantially linear direction upon activation of the linear actuator, and at least one rotatable gear meshing with the rack gear and operatively connected to the valve element to cause rotation of the valve element upon actuation of the linear actuator; and a return spring operatively connected to the rack gear for biasing the rack gear to a non-actuated position.

3. The apparatus of claim 2, further including an adjustable stop mechanism for limiting the rotational travel of the valve element.

4. The apparatus of claim 3, wherein the adjustable stop mechanism includes a stop lever operatively connected to the valve element for rotation therewith.

5. An exhaust gas recirculation valve comprising:

an exhaust passage tube;

a valve element pivotally mounted entirely within the exhaust passage tube;

an adjustable stop mechanism for limiting the rotational travel of the valve element;

a linear actuator; and a gear train including a rack gear operatively connected to the linear actuator, the rack gear adapted to move in a substantially linear direction upon activation of the linear actuator, and at least one rotatable gear meshing with the rack gear and operatively connected to the valve element to cause rotation of the valve element upon actuation of the linear actuator.

6. The apparatus of claim 5, wherein the adjustable stop mechanism includes a stop lever mounted to the spindle.

7. An exhaust gas recirculation valve comprising:

an exhaust passage tube;

a valve element pivotally mounted entirely within the exhaust passage tube;

a linear actuator; and a gear train including a rack gear operatively connected to the linear actuator, the rack gear adapted to move in a substantially linear direction upon activation of the linear actuator, and at least one rotatable gear meshing with the rack gear and operatively connected to the valve element to cause rotation of the valve element upon actuation of the linear actuator, wherein the gear train includes a plurality of rotatable gears.

8. An exhaust gas recirculation valve comprising:

an exhaust passage tube having a first axis;

a valve element pivotally mounted entirely within the exhaust passage tube;

an apparatus adapted for linear movement along a second axis substantially parallel to the first axis, the apparatus adapted for linear movement along the second axis adapted to be selectively activated;

an actuator rod directly driven by the apparatus adapted for linear movement along the second axis, the actuator rod adapted to move in a substantially linear direction upon activation of the apparatus adapted for linear movement along the second axis; and a gear train including a rack gear, disposed along at least a portion of the length of the actuator rod, and at least one rotatable gear meshing with the rack gear, the rotatable gear being operatively connected to the valve element and adapted to cause rotation of the valve element upon actuation of the apparatus adapted for linear movement along the second axis.

9. The apparatus of claim 8, further including a return spring operatively connected to the actuator rod for returning the actuator rod to a non-actuated position when the apparatus adapted for linear movement along the second axis is not activated.

10. The apparatus of claim 8, further including an adjustable stop mechanism for limiting the rotational travel of the valve element.

11. The apparatus of claim 10, wherein the adjustable stop mechanism includes a stop lever operatively connected to the valve element for rotation therewith.

* * * * *

UNITED STATES PATENT AND TRADEMARK OFFICE

CERTIFICATE OF CORRECTION

PATENT NO. : 6,843,239 B2
DATED : January 18, 2005
INVENTOR(S) : David J. Kidder et al.

It is certified that error appears in the above-identified patent and that said Letters Patent is hereby corrected as shown below:

Title page,
Item [56], References Cited, U.S. PATENT DOCUMENTS, should be included:
-- 4,651,408 MacElwee et al. 03/24/1987. --

Signed and Sealed this

Twenty-sixth Day of April, 2005

JON W. DUDAS
*Director of the United States Patent and Trademark Office*